US007643785B2

(12) United States Patent
Matsubara et al.

(10) Patent No.: US 7,643,785 B2
(45) Date of Patent: Jan. 5, 2010

(54) IMAGE HEATING DEVICE CAPABLE OF CHANGING PRESSURE APPLIED TO HEATING NIP

(75) Inventors: Hideyuki Matsubara, Mishima (JP); Kazunari Nishimoto, Numazu (JP); Shigeo Murayama, Susono (JP); Takao Kawazu, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 350 days.

(21) Appl. No.: 11/691,308

(22) Filed: Mar. 26, 2007

(65) Prior Publication Data

US 2007/0223977 A1 Sep. 27, 2007

(30) Foreign Application Priority Data

Mar. 27, 2006 (JP) ..... 2006-084515

(51) Int. Cl.
*G03G 15/20* (2006.01)

(52) U.S. Cl. ..... 399/329; 399/331

(58) Field of Classification Search ..... 399/320, 399/328, 329, 330, 331
See application file for complete search history.

(56) References Cited

FOREIGN PATENT DOCUMENTS

| | | | |
|---|---|---|---|
| JP | 02-157756 A | | 6/1990 |
| JP | 02266384 | * | 10/1990 |
| JP | 11-125985 A | | 11/1999 |
| JP | 2000-029347 A | | 1/2000 |

* cited by examiner

*Primary Examiner*—Hoang Ngo
(74) *Attorney, Agent, or Firm*—Canon USA Inc IP Div

(57) ABSTRACT

An image heating device includes a pressure-changing mechanism configured to change pressure applied to a heating nip. A cam of the pressure-changing mechanism acting on a pressure-applying mechanism is attached to a rotating shaft of a conveying roller that conveys recording materials. With this, an increase in the cost of the device can be regulated.

9 Claims, 9 Drawing Sheets

IMAGE HEATING DEVICE CAPABLE OF CHANGING PRESSURE APPLIED TO HEATING NIP

BACKGROUND OF THE INVENTION

1. Field of the Invention

The present invention relates to image heating devices for heating recording materials that carry images, and in particular, relates to those used as heat fixing devices for heating recording materials having unfixed images (toner images) formed thereon in image forming apparatuses such as printers that form images on recording materials using image forming processes such as electrophotographic processes.

2. Description of the Related Art

Among various fixing devices, which are examples of image heating devices, in practical use, those of the heating roller type are the most popular. Fixing devices of this type include a fixing nip formed of a fixing roller and a pressurizing roller. The fixing devices fix toner images on recording materials that carry the toner images by applying heat and pressure to the recording materials using the fixing nip. The fixing roller and the pressurizing roller are pressed into contact with each other by a pressure-applying mechanism. Moreover, some of these fixing devices include a depressurizing mechanism for removing or reducing the pressure applied to both rollers by the pressure-applying mechanism in order to easily remove recording materials jammed in the fixing nip, or in order to regulate the deformation of rubber layers of the fixing roller and the pressurizing roller caused by the pressure-contact state continued over a long period of time. In addition, some of these fixing devices include a mechanism for changing the pressure applied to both rollers by the pressure-applying mechanism in order to ensure the optimum fixability of the toner images.

Pressure-changing mechanisms (hereinafter referred to as mechanisms having at least one of a depressurizing function and a pressure-changing function) of the most popular type include cam members. In general, a pressure-applying mechanism that applies pressure between the fixing roller and the pressurizing roller uses springs or the like disposed at either end of the rollers, and thus each of the cam members also needs to be disposed adjacent to either end of the rollers. The pressure applied between the rollers by this pressure-applying mechanism can be changed by rotating the cam members acting on the pressure-applying mechanism manually or using motor power. For example, those disclosed in Japanese Patent Laid-Open Nos. 2-157756, 11-125985, and 2000-29347 rotate the cam members using motor power.

In general, the pressure-changing mechanisms using motor power as disclosed in Japanese Patent Laid-Open Nos. 11-125985 and 2000-29347 rotate two cam members by transmitting the motor power to one end of the rollers. In this case, a dedicated shaft for supporting the two cam members is required. Moreover, this shaft requires a certain degree of torsional rigidity such that the rotational phases of the two cam members do not vary widely. This leads to an increase in production costs, and also leads to an increase in the size of the device for ensuring the space for the dedicated shaft.

SUMMARY OF THE INVENTION

The present invention is directed to an image heating device capable of regulating increases in the production costs and the size of the device.

According to one aspect of the present invention, an image heating device for heating an image formed on a recording material includes a nip-forming member; a pressure-applying mechanism configured to apply pressure to the nip-forming member so as to form a heating nip; and a pressure-changing mechanism including a rotatable cam member acting on the pressure-applying mechanism so as to change the pressure applied to the nip-forming member by the pressure-applying mechanism. The cam member is attached to a rotating shaft of a rotating body that can be brought into contact with the recording material.

Further features of the present invention will become apparent from the following description of exemplary embodiments with reference to the attached drawings.

DESCRIPTION OF THE EMBODIMENTS

Figure 1:
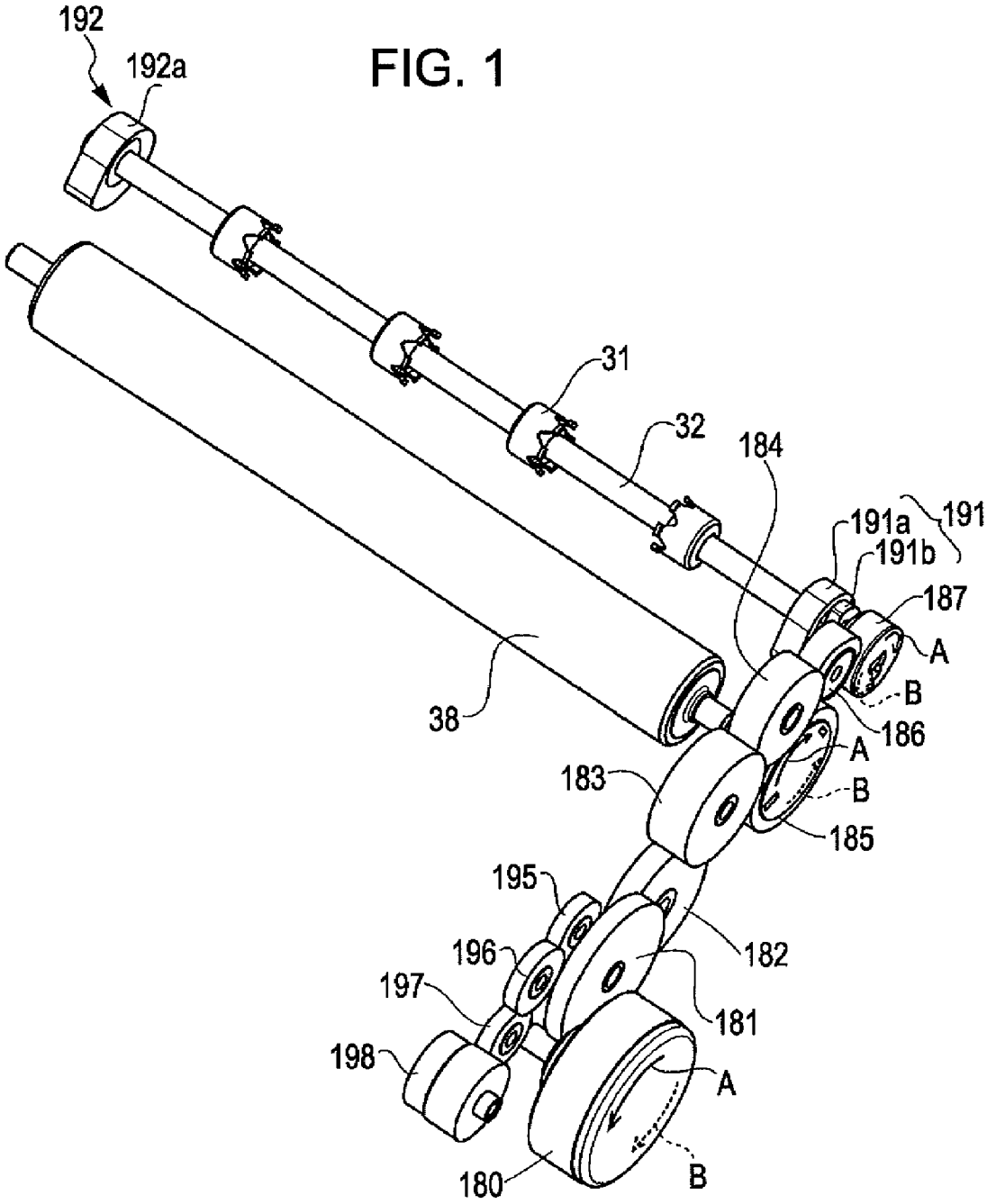
FIG. 1 is a perspective view of a power transmission channel from a motor to a fixing unit according to a first exemplary embodiment of the present invention.

Exemplary embodiments of the present invention will now be described in detail with reference to the drawings. However, the dimensions, materials, shapes, relative arrangements, and the like of components described in the exemplary embodiments can be changed according to the structures or various conditions of the apparatuses to which the present invention is applied, and do not limit the scope of the present invention unless otherwise specified. Moreover, the below-mentioned pressure-changing mechanism is defined as a mechanism having at least one of a depressurizing function and a pressure-changing function.

First Embodiment

A first exemplary embodiment of the present invention will now be described with reference to FIGS. 1 to 7. In this exemplary embodiment, a fixing unit in an image forming apparatus is illustrated as an example of an image heating device. Moreover, a laser beam printer is illustrated as an example of the image forming apparatus.

First, the structure of the image-forming apparatus will be briefly described in the order of components thereof through which recording materials S flow. An image forming apparatus E shown in FIG. 6 forms images by the electrophotographic recording method. The recording materials S are conveyed one by one from a sheet-feeding section 1 to an image forming section 2, and toner images are transferred to the recording materials S. The recording materials S are conveyed to a fixing section 3 such that the toner images are fixed, and then discharged to an ejecting section. More specifically, a cassette 11 that constitutes the sheet-feeding section 1 and accommodates the recording materials S is loaded in the lower portion of the apparatus. The recording materials S accommodated in the cassette 11 are fed from the top one by one by a feeding roller 12 that is rotated clockwise, and sent to the image forming section 2 using pairs of conveying rollers 13 and 14.

A sensor lever 15 and a photointerrupter 16 of the light-transmission type are disposed adjacent to the image forming section 2 so as to detect the passage of the recording materials S. A light-shielding portion of the sensor lever 15 is disposed between a light-emitting side and a light-detecting side, and is retracted when a recording material S rotates the sensor lever 15 by the passage thereof. With this, the recording material S is detected. Moreover, the sensor lever 15 returns to its original position after the passage of the recording material S since the sensor lever 15 is biased by an elastic member (not shown). When a predetermined period has elapsed since the detection of the passage of the recording material S, laser beams according to image information are emitted from a laser scanner 21 to a photosensitive member 22 rotated counterclockwise so as to form an electrostatic latent image on the photosensitive member 22. This electrostatic latent image is developed at a developing section inside a process cartridge P. The toner image formed on the photosensitive member 22 is transferred to the recording material S by a transferring roller 24 as an unfixed image. The recording material S carrying the unfixed image is sent to the fixing section 3 so as to be subjected to a fixing process in a fixing unit T in the fixing section 3. After the fixing process, the recording material S passes through the fixing section 3, and is conveyed to the ejecting section located in the upper portion of the apparatus using sheet-ejecting rollers 33.

Figure 6:
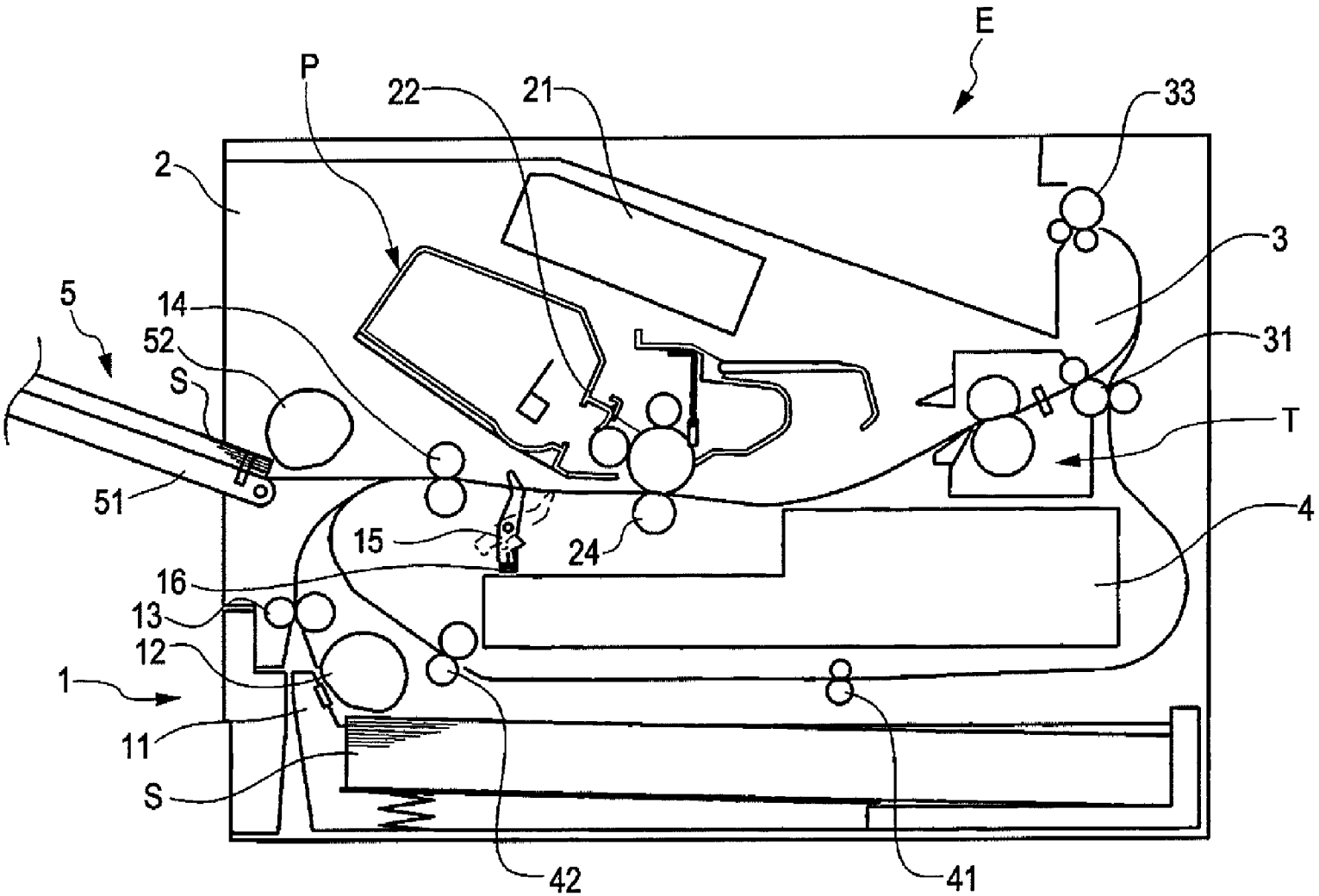
FIG. 6 is a schematic cross-sectional view of an electrophotographic image forming apparatus including the fixing unit.

In FIG. 6, an electrical unit 4 includes a power-supply portion of the apparatus and a control board for controlling the apparatus.

Operations during double-sided recording on a recording material S will now be described. In the case of double-sided recording on both surfaces of the recording material S, the recording material S having an image formed on the top surface thereof and passing through the fixing section 3 is guided back using the reversely driven sheet-ejecting rollers 33 and conveying rollers 31. Subsequently, the recording material S is conveyed to the image forming section 2 again using pairs of conveying rollers 41 and 42. The recording material S is ejected after another image is formed on the bottom surface thereof in the same manner as described above.

When the recording materials S are supplied from a manual-feeding section 5, a manual-feeding tray 51 is opened, and the recording materials S are stacked on the manual-feeding tray 51. The recording materials S stacked on the manual-feeding tray 51 are fed from the top one by one using a manual-feeding roller 52 that is rotated counterclockwise, and sent to the image forming section 2 using the pair of conveying rollers 14. Operations after the recording materials S are sent to the image forming section 2 are the same as those described above, and the descriptions are omitted.

The structure of the fixing unit T in this exemplary embodiment will now be described in more detail with reference to FIG. 7.

Figure 7:
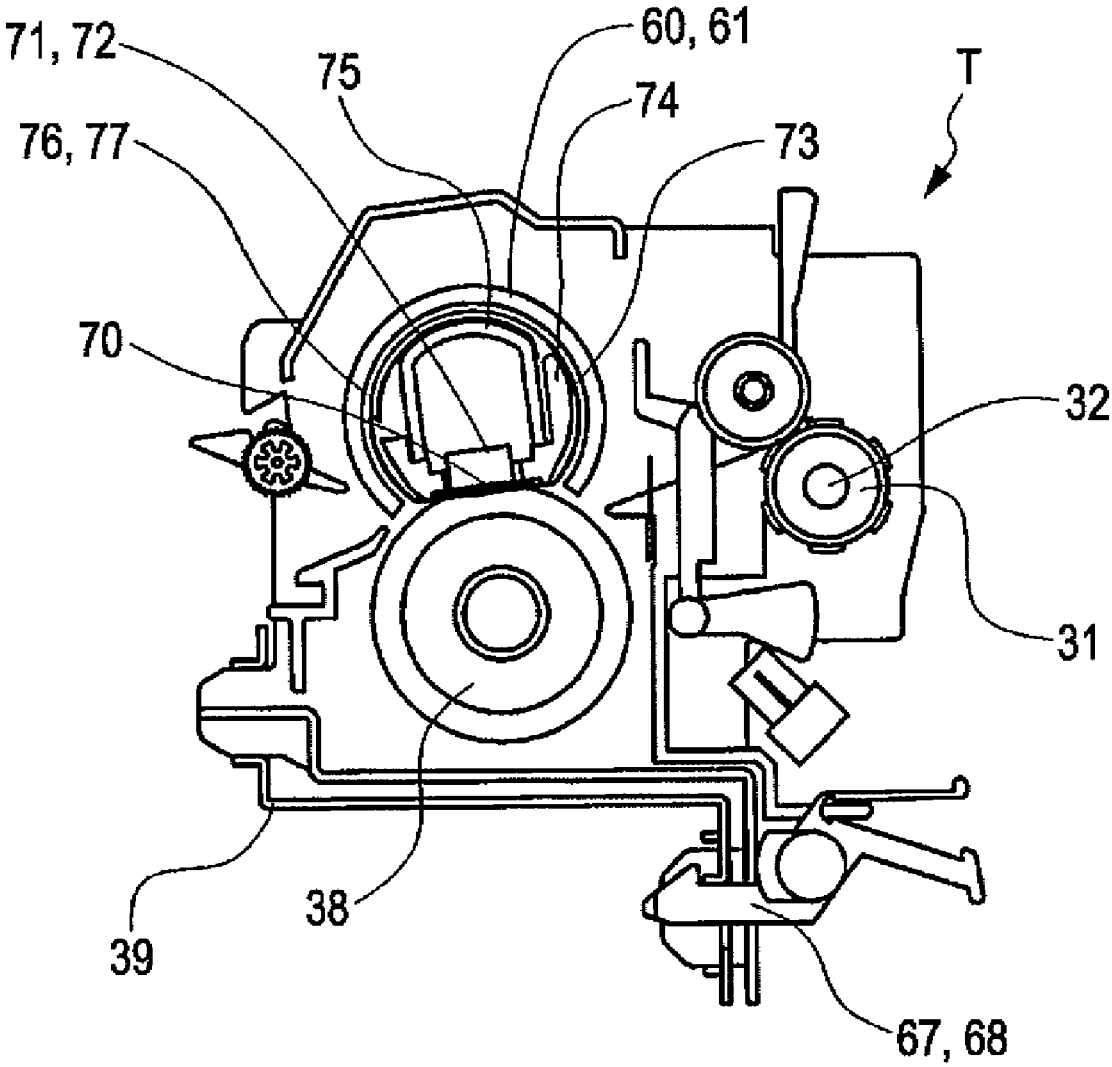
FIG. 7 is a cross-sectional view of the fixing unit adjacent to an end of a fixing film in the longitudinal direction of the fixing unit.

The fixing unit T shown in FIG. 7 includes a heater 70 serving as a heating body. The heater can include a ceramic board composed of alumina or aluminum nitride having a silver-alloy heating element that generates heat by current passage, silver-alloy electrodes, and the like formed thereon by screen printing. The heating element is connected to an AC control circuit. A thermistor 71 serving as a temperature-detecting unit is attached on the heater 70 so as to detect the temperature of the heater 70. Moreover, a thermal fuse or a thermoswitch 72 serving as a thermal protector is attached on the heater 70, and is connected to an AC source in series with the heating element. A fixing film (flexible sleeve) 73 includes a cylindrical base composed of polyimide resin or stainless steel and an elastic rubber layer composed of silicon rubber, fluororubber, or the like covering the base. The elastic rubber layer is coated with fluorocarbon resin. The fixing film 73 does not necessarily include the elastic rubber layer. A film guide 74 composed of heat-resistant resin such as PPS, PEEK™, liquid crystal polymer, or the like supports the heater 70. An iron reinforcing plate 75 has a U-shaped cross-section. The fixing film 73 and components such as the film guide 74, the heater 70, and the reinforcing plate 75 installed inside the fixing film 73 form a heating unit. A pressurizing roller 38 includes a shaft composed of aluminum, iron, or the like and an elastic layer composed of silicon rubber, fluororubber, or the like covering the shaft. Flanges 60 and 61 are disposed at either end of the fixing film 73 in the longitudinal direction of the fixing film 73 so as to oppose each other, and regulate the traveling locus of the fixing film 73 using the outer or inner peripheries thereof. In this exemplary embodiment, the displacement of the fixing film in the longitudinal direction of the fixing film and the traveling locus of the fixing film at either end of the fixing film are regulated using the inner peripheries of the flanges. A contact spring 76 that applies voltage to the inner surface of the fixing film 73 or grounds the fixing film 73 and a thermistor 77 for detecting the temperature of the inner surface of the fixing film 73 are in elastic contact with the inner surface of the fixing film 73 so as to be slidable. Application of pressure to the heating unit including the fixing film 73 and the components such as the film guide 74, the heater 70, and the reinforcing plate 75 installed inside the fixing film 73 and the pressurizing roller 38 using the below-mentioned pressure-applying mechanism form a pressure-contact nip (heating nip) N. Unfixed images formed on the recording materials S are fixed on the recording materials S after the recording materials S pass through this pressure-contact nip N.

Next, pressurizing components for forming the pressure-contact nip N will be described with reference to FIGS. 1 to 4, and 7. Both ends of the shaft of the pressurizing roller (nip-forming member) 38 are supported by side plates (not shown) fixed inside the fixing unit T so as to be rotatable. The heating unit is supported by the side plates so as to be movable in a direction toward the pressurizing roller 38. Application of loads to the flanges 60 and 61 using pressurizing plates (parts of the pressure-applying mechanism) 65 and 66 forms the pressure-contact nip N. The pressurizing plates 65 and 66 are disposed at either end of the heating unit in the longitudinal direction of the heating unit, and first ends of the pressurizing plates 65 and 66 are hooked on an upper plate 64, which is a part of the frame of the fixing unit T. Pressurizing springs (parts of the pressure-applying mechanism) 62 and 63 that apply loads to the flanges 60 and 61, respectively, are disposed between the upper plate 64 and the pressurizing plates 65 and 66. Therefore, the urging force of the pressurizing springs 62 and 63 is applied to the heater 70 via the pressurizing plates 65 and 66, the flanges 60 and 61, the reinforcing plate 75, and the film guide 74. In addition to the above-described components, the fixing unit T includes the conveying rollers 31 serving as rotating bodies to be brought into contact with the recording materials disposed downstream of the heating unit and the pressurizing roller 38 in the conveying direction of the recording materials. The fixing unit T is attached to a stay 39 fixed to the image forming apparatus E so as to be easily detached from the image forming apparatus E by operating levers 67 and 68. Only one of the flanges 60 and 61, one of the pressurizing plates 65 and 66, one of the pressurizing springs 62 and 63 disposed at either end of the heating unit, and one of the levers 67 and 68 disposed at either end of the pressurizing roller 38 adjacent to one end of the fixing unit are illustrated. However, the structures of the components adjacent to the other end are the same as those adjacent to the one end.

As described above, the pressure-applying mechanism configured to apply pressure so as to form the pressure-contact nip N includes components for applying pressure such as the upper plate 64, the pressurizing springs 62 and 63, and the pressurizing plates 65 and 66. However, the structure of the pressure-applying mechanism is not limited to that described above. Structures other than that can be possible as long as the pressure-applying mechanism can apply pressure so as to form the pressure-contact nip N.

Operation of Fixing Unit

Next, operations of the fixing unit during image formation and during releasing or non-releasing (pressurizing) of the pressure-contact nip in this exemplary embodiment will be described.

Figure 2:
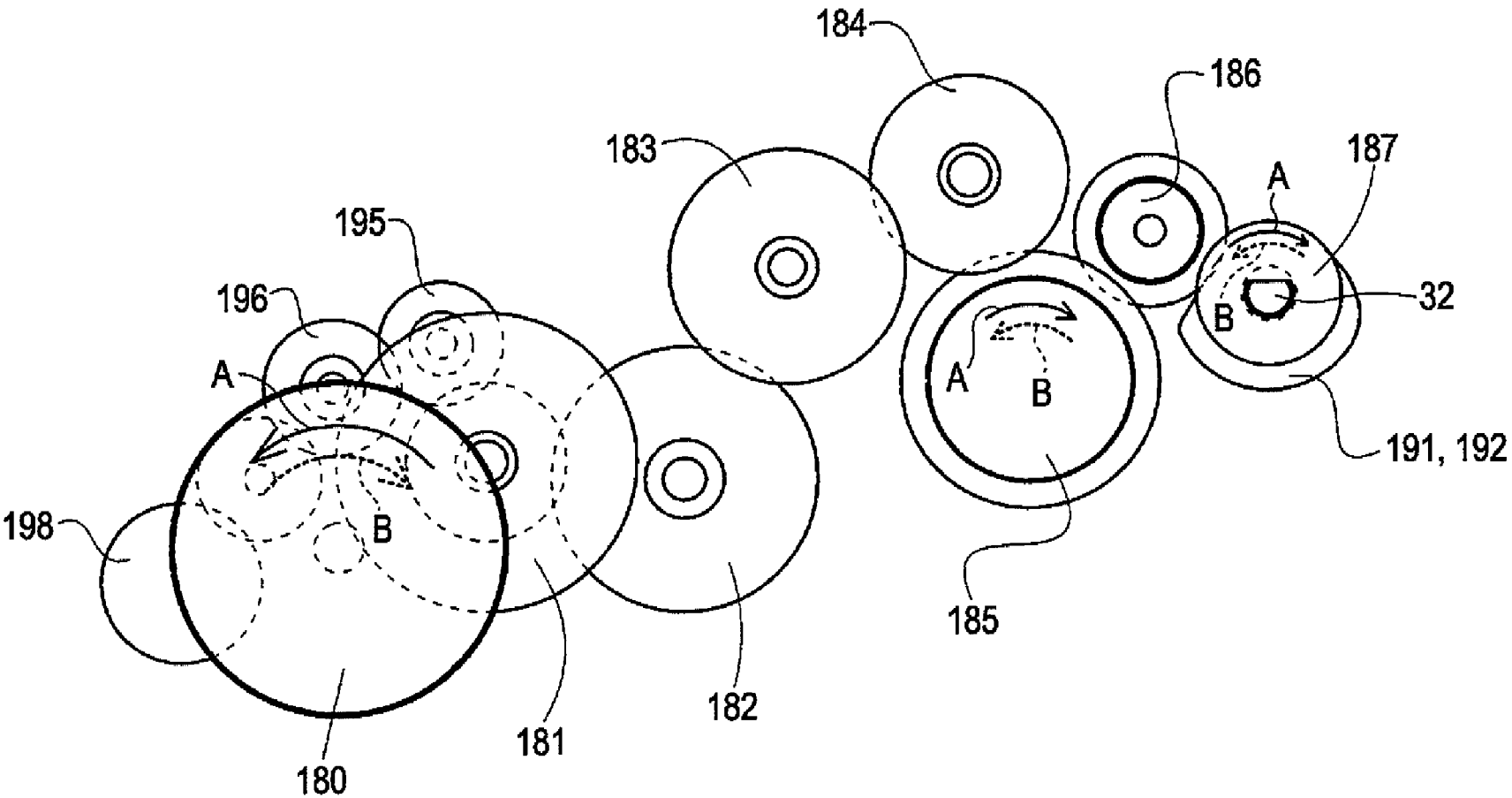
FIG. 2 illustrates gears that constitute the power transmission channel shown in FIG. 1.

With reference to FIGS. 1 and 2, the fixing unit T is driven by a motor 180 serving as a driving source attached to the image forming apparatus E. This motor 180 can be a DC motor, a stepping motor, or the like capable of rotating in a normal direction and in a reverse direction. The power of the motor 180 is transmitted to the fixing unit T by gears 181 to 184 provided for the image forming apparatus E. Unitized gears 185 to 187 are provided for the fixing unit T. Moreover, the driving force of the motor 180 is transmitted to other loads of the image forming apparatus E by gears 195 to 198 via the gear 181. The gear line disposed at one end of the fixing unit T in the longitudinal direction of the fixing unit T is the only power transmission channel to the fixing unit T. Since the same gear line is used for transmitting power to the fixing unit T while the motor is rotated both in the normal direction and in the reverse direction, no separate gear lines are required for driving the fixing unit T and for releasing the pressure-contact nip. Thus, the space-saving and low-cost image forming apparatus E and fixing unit T can be realized.

The gear 185 attached to the shaft of the pressurizing roller 38 includes a one-way clutch. The power of the motor is transmitted from the gear 185 to the pressurizing roller 38 during the rotation of the motor 180 in the normal direction (in the direction of an arrow A), and is not transmitted from the gear 185 to the pressurizing roller 38 during the rotation of the motor 180 in the reverse direction (in the direction of an arrow B). The gear 186 is engaged with the gear 185, and the gear 187 engaged with the gear 186 transmits the power to the conveying rollers 31. Both gears 186 and 187 are rotated either when the gear 185 is rotated in the direction of the arrow A or when the gear 185 is rotated in the direction of the arrow B.

The fixing unit T includes a pressure-changing mechanism for changing the pressure applied to the pressure-contact nip N. The pressure-changing mechanism includes cams 191 and 192 serving as cam members acting on the pressure-applying mechanism so as to change the pressure applied to the pressure-contact nip N using the rotation of the cams 191 and 192. The cams 191 and 192 in this exemplary embodiment act on the pressurizing plates 65 and 66, respectively, which are parts of the pressure-applying mechanism. In this exemplary embodiment, the pressure-changing mechanism includes components for changing pressure such as the motor 180 for driving the pressurizing roller 38 in addition to the cams 191 and 192. However, the structure of the pressure-changing mechanism is not limited to that described above. Structures other than that can be possible as long as the pressure-changing mechanism includes the cams 191 and 192 acting on the pressure-applying mechanism and can change the pressure applied to the pressure-contact nip N using the rotation of the cams 191 and 192.

The cams 191 and 192, serving as cam members that act on the pressure-applying mechanism, each include a one-way clutch (one-way clutch mechanism). The cams are attached to a rotating shaft of a rotating body provided for the fixing unit T and to be brought into contact with the recording materials. In this exemplary embodiment, the cams 191 and 192 are disposed on a rotating shaft 32 of the conveying rollers 31 located at a position remote from the pressure-contact nip N in the conveying direction of the recording materials. The power of the motor 180 is not transmitted from the rotating shaft 32 of the conveying rollers 31 to the cams 191 and 192 during the rotation of the motor 180 in the normal direction (the direction of the arrow A). The power is transmitted from the rotating shaft 32 of the conveying rollers 31 to the cams 191 and 192 during the rotation of the motor 180 in the reverse direction (the direction of the arrow B). When the motor 180 is rotated in the normal direction, the conveying rollers 31 are rotated in a direction along which the recording materials are discharged during fixing (the conveying direction of the recording materials). When the motor 180 is rotated in the reverse direction, the conveying rollers 31 are rotated in a direction opposite to the conveying direction of the recording materials. In this manner, the power transmission to the cams 191 and 192 at either end is performed using the rotating shaft of the conveying rollers 31. Since the rotating shaft 32 of the conveying rollers 31 is used for the power transmission to the cams 191 and 192 as described above, no other components for transmitting the power to the cams 191 and 192 are required. Thus, the space-saving and low-cost image forming apparatus E and fixing unit T can be realized.

The cams 191 and 192 include cam surfaces 191*a* and 192*a*, respectively, for controlling the positions of the pressurizing plates 65 and 66. Moreover, the cam 191 includes a cam surface 191*b* for detecting and controlling the state of the pressure-contact nip N. Releasing and non-releasing of the pressure-contact nip N is controlled using the cam surface 191*b* of the cam 191, a cam sensor lever 194, a cam sensor 193, and the electrical unit (control unit) 4 of the image forming apparatus E. The cam sensor 193 is of the transmissive type. The cam sensor detects the released or non-released state of the pressure-contact nip N using a light-shielding portion of the cam sensor lever 194 disposed between a light-emitting portion and a light-detecting portion, the light-shielding portion blocking or passing light. Moreover, the cam sensor lever 194 and the cam sensor 193 are disposed inside the fixing unit T. Since the sensing components for detecting the state of the pressure-contact nip N inside the fixing unit T are disposed inside the fixing unit T instead of the image forming apparatus E, the size of the apparatus is not increased, and the accuracy in detecting the state of the pressure-contact nip N can be improved.

Operation During Image Formation

Figure 3:
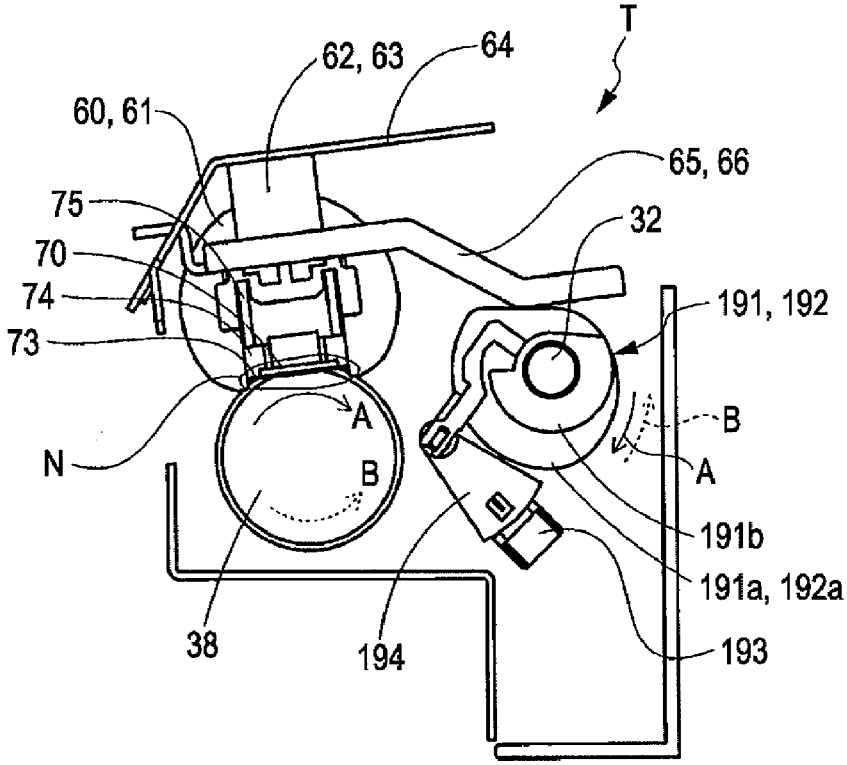
FIG. 3 illustrates the fixing unit without a side plate thereof viewed from one end of the unit in the longitudinal direction thereof, where a pressure that is the same as that during fixing is applied to a heating nip.

As shown in FIGS. 2 and 3, the motor 180 is rotated in the direction of the arrow A during the image formation, and the power is transmitted to the pressurizing roller 38 and the conveying rollers 31 by the gears 181 to 184. The rotation of the pressurizing roller 38 and the conveying rollers 31 in the normal direction (direction of the arrow A) fixes the unfixed images on the recording materials and conveys the recording materials. At this moment, the pressure-contact nip N is formed by pressing the heating unit toward the pressurizing roller using the upper plate 64, the pressurizing springs 62 and 63, and the pressurizing plates 65 and 66.

As described above, the cams 191 and 192 according to this exemplary embodiment are attached to the rotating shaft 32 of the conveying rollers 31 via the one-way clutches (one-way clutch mechanisms). The cams 191 and 192 are rotated so as to raise the pressurizing plates 65 and 66 against the force of the pressurizing springs 62 and 63 only when the rotating shaft 32 of the conveying rollers 31 are rotated in the direction of the arrow B.

However, a small amount of torque (idling torque) is generated also when the rotating shaft 32 of the conveying rollers 31 is rotated in the direction of the arrow A by the friction inside the one-way clutches. This idling torque is not so large as to raise the pressurizing plates 65 and 66 against the force of the pressurizing springs 62 and 63. Moreover, in this exemplary embodiment, the cams 191 and 192 are in contact with the pressurizing plates 65 and 66, respectively, as shown in FIG. 3, during the image formation, i.e., when a normal pressure is applied to the pressure-contact nip N. Therefore, the cams 191 and 192 are not rotated when the idling torque is generated by the rotation of the conveying rollers 31 in the direction of the arrow A. However, when the phases of the cams 191 and 192 at the start of the rotation of the conveying rollers 31 are slightly shifted from the positions shown in FIG. 3 (initial positions) in the direction of the arrow B, the cams 191 and 192 are not in contact with the pressurizing plates 65 and 66, respectively. When the idling torque in the direction of the arrow A is generated while the cams 191 and 192 are not in contact with the pressurizing plates 65 and 66, respectively, the cams 191 and 192 are rotated until the cams 191 and 192 are brought into contact with the pressurizing plates 65 and 66, respectively (initial positions).

As described above, when the phases of the cams 191 and 192 at the start of the rotation of the motor correspond to the initial positions, the cams 191 and 192 are not rotated even when the motor 180 is rotated in the direction of the arrow A. However, when the phases of the cams 191 and 192 at the start of the rotation of the motor are shifted from the initial positions in the direction of the arrow B, idling torque of the one-way clutches is transmitted to the cams 191 and 192 and rotates the cams until the phases of the cams correspond to the initial positions. Since the position initialization is performed using the idling torque of the one-way clutches as described above, no other components for initializing the positions of the cams are required. Thus, the space-saving and low-cost image forming apparatus E and fixing unit T can be realized. The idling torque of the one-way clutches is much smaller than the pressurizing force of the pressurizing springs 62 and 63. While the cam sensor lever 194 is in contact with the cam surface 191*b* of the cam 191, the cam sensor 193 receives light. With this, the non-released state of the pressure-contact nip is detected.

In this exemplary embodiment, the cams are not always in contact with the pressurizing plates. However, the cams can always be in contact with the pressurizing plates.

Operation During Releasing of Pressure-Contact Nip N

Figure 4:
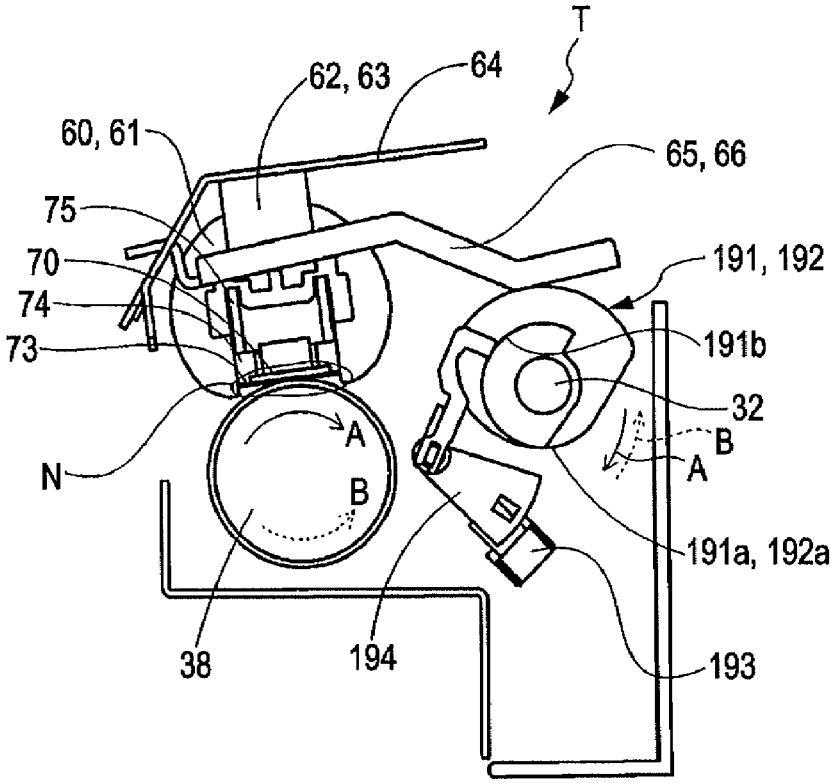
FIG. 4 illustrates the fixing unit without the side plate thereof viewed from one end of the unit in the longitudinal direction thereof, where the pressure is removed.

When it is necessary to release the pressure-contact nip N, the motor 180 is rotated in the reverse direction (direction of the arrow B). As shown in FIGS. 2 and 4, the power of the rotation of the motor 180 in the reverse direction is transmitted to the fixing unit T by the gears 181 to 184. Since the power of the motor rotated in the reverse direction is transmitted using the same gear line as that used for transmitting the power of the motor rotated in the normal direction, the space-saving and low-cost image forming apparatus E and fixing unit T can be realized. Although the gear 185 is rotated in the reverse direction, the power is not transmitted to the pressurizing roller 38 due to the effect of the one-way clutch of the gear 185. Accordingly, the pressurizing roller 38 and the fixing film 73 are not rotated in the reverse direction. As a result, the contact spring 76 and the thermistor 77, which are in contact with the inner surface of the fixing film 73 so as to be slidable, are not damaged. The power in the reverse direction (direction of the arrow B) transmitted from the gear 185 to the gears 186 and 187 and the rotating shaft 32 of the conveying rollers 31 is transmitted to the cams 191 and 192 via the one-way clutches so as to rotate the cams 191 and 192. The pressurizing plates 65 and 66 are moved against the force of the pressurizing springs 62 and 63 by the cam surfaces 191*a* and 192*a* of the cams 191 and 192, respectively, so as to release the pressure-contact nip N. When it is detected that the pressure-contact nip N is released using the cam surface 191*b* of the cam 191, the cam sensor lever 194, and the cam sensor 193, the rotation of the motor 180 is stopped. Releasing the pressure-contact nip N can minimize permanent deformation of the elastic layer of the pressurizing roller 38, and allows easy removal of the recording materials jammed in the fixing unit. Therefore, in this exemplary embodiment, the pressure-contact nip is automatically released when the image forming apparatus is switched off and when jamming of the recording materials occurs.

Operation During Return of Pressure-Contact Nip N from Released State to Non-Released State When it is necessary to return the pressure-contact nip N from the released state to the non-released state, the motor 180 is further rotated in the reverse direction (direction of the arrow B). Although the power is transmitted to the cams 191 and 192, the fixing film 73 and the pressurizing roller 38 are not rotated at this moment as described above. As a result, the contact spring 76 and the thermistor 77, which are in contact with the inner surface of the fixing film 73 so as to be slidable, are not damaged. The power from the motor 180 is transmitted to the cams 191 and 192, and the cams 191 and 192 are rotated in the reverse direction (direction of the arrow B) so as to bring the pressure-contact nip N into the non-released state (pressure-contact state). When it is detected that the pressure-contact nip N is returned to the non-released state using the cam surface 191*b* of the cam 191, the cam sensor lever 194, and the cam sensor 193, the rotation of the motor 180 is stopped. When the motor 180 is rotated in the normal direction (direction of the arrow A) after the pressure-contact nip N is returned to the non-released state, the cams 191 and 192 are brought into contact with the pressurizing plates 65 and 66, respectively, by the idling torque of the one-way clutches inside the cams 191 and 192, and then are stopped. At this moment, the cams 191 and 192 are located at their initial positions.

The pressure applied to the pressure-contact nip N is not necessarily removed completely, but can be reduced during releasing of the pressure-contact nip N. This can be realized by appropriately setting the shapes of the cam surfaces 191*a* and 192*a* of the cams 191 and 192, respectively, for controlling the positions of the pressurizing plates. The cam surfaces 191*a* and 192*a* designed to have various patterns for various pressure applications can realize fixing units capable of varying the pressure applied to the pressure-contact nip N.

Timing of Releasing and Non-Releasing of Pressure-Contact Nip N

Figure 5:
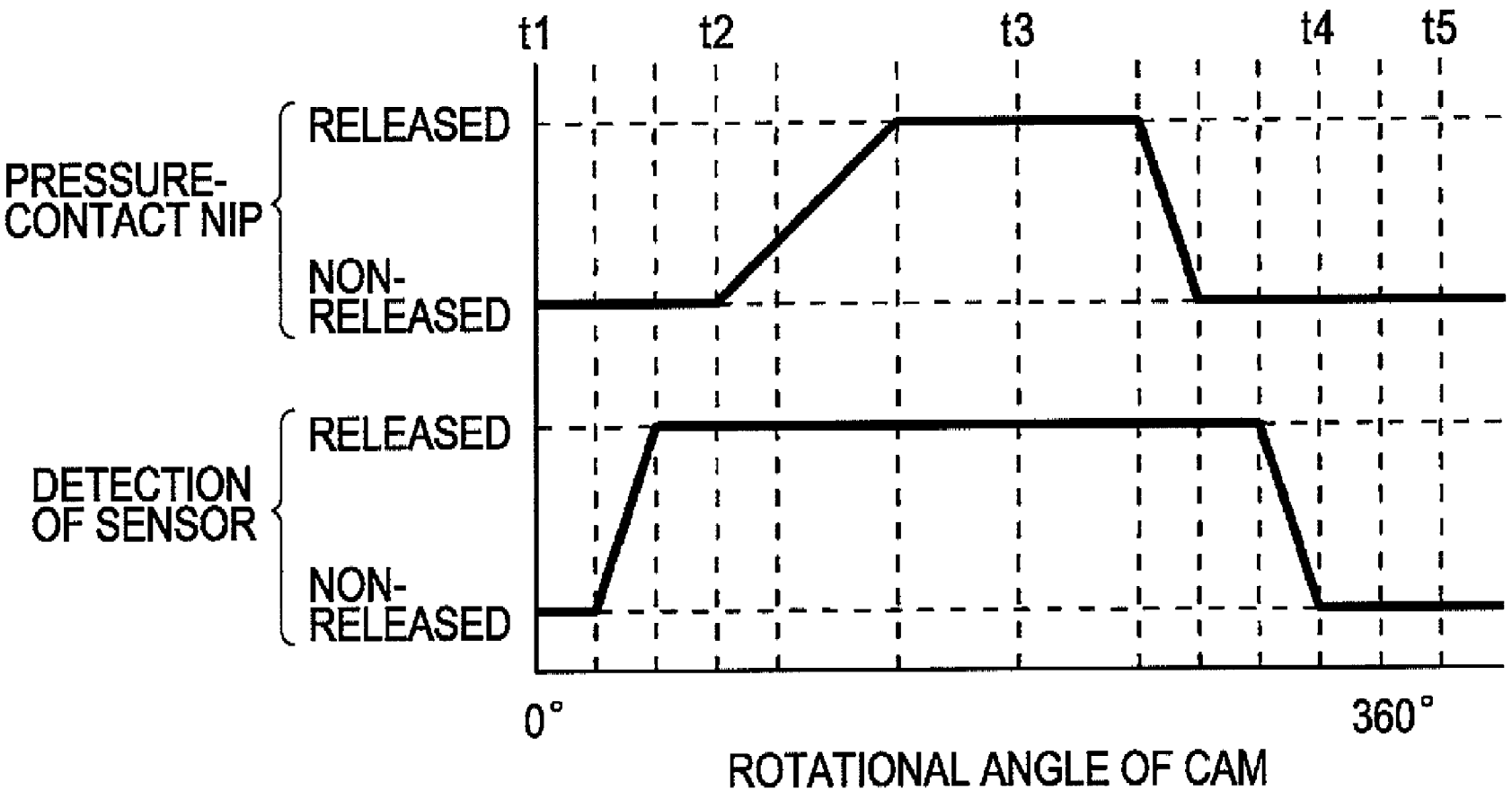
FIG. 5 illustrates the relationship between the pressure applied to the heating nip (pressure-contact nip) and the phase (rotational angle) of a cam member.

Timing of detecting the state of the pressure-contact nip N will now be described with reference to FIG. 5. The released/non-released state of the pressure-contact nip N and the state of the pressure-contact nip N detected using the cam surface 191*b*, the cam sensor lever 194, and the cam sensor 193 will be described using timings t1 to t5 shown in FIG. 5.

At the timing t1, the motor 180 starts rotating (in the direction of the arrow B shown in FIG. 3). After the cam sensor 193 detects the released state of the pressure-contact nip N, releasing of the pressure-contact nip N is started at the timing t2. After a predetermined time has elapsed since the detection of the released state of the pressure-contact nip N by the cam sensor 193, the rotation of the motor 180 is stopped at the timing t3. At this moment, the pressure-contact nip N is in the released state. After the rotation (in the direction of the arrow B shown in FIG. 3) of the motor 180 is started and the pressure-contact nip N is returned to the non-released state, the cam sensor 193 detects the non-released state of the pressure-contact nip N at the timing t4. After a predetermined time has elapsed since the detection of the non-released state of the pressure-contact nip N by the cam sensor 193, the rotation of the motor 180 is stopped at the timing t5. At this moment, the pressure-contact nip N is in the non-released state.

In this manner, the released state and the releasing operation of the pressure-contact nip N can always be detected. As a result, the pressure-contact nip N is always in the non-released state (capable of image formation) while the cam sensor 193 detects the non-released state of the pressure-contact nip N, and a predetermined pressure can be reliably applied during the image formation.

As described above, the cams 191 and 192 acting on the pressure-applying mechanism configured to apply pressure so as to form the pressure-contact nip N are attached to the rotating shaft 32 of the conveying rollers 31 of the fixing unit T in this exemplary embodiment. With this structure, the pressure applied to the pressure-contact nip N can be changed without an increase in the cost or size of the fixing unit T and the image forming apparatus E.

Since the conveying rollers 31 and the cams 191 and 192 are rotated by the power of the motor 180 that drives the pressurizing roller 38 serving as a nip-forming member for forming the pressure-contact nip N, no other driving source is required. Thus, the space-saving and low-cost image forming apparatus E and fixing unit T can be realized.

Second Embodiment

A second exemplary embodiment of the present invention will now be described with reference to FIGS. 8 to 11B. In this exemplary embodiment, the same reference numbers and symbols are used for components substantially the same as those in the first exemplary embodiment. Moreover, descriptions of structures and functions similar to those in the first exemplary embodiment are omitted, and only features of this exemplary embodiment will be described.

The structure of the fixing unit T in this exemplary embodiment will now be described in detail with reference to FIGS. 8 to 11B. The structure of the fixing unit T in this exemplary embodiment is the same as that in the first exemplary embodiment in that cam members for changing pressure are attached to a rotating shaft of a rotating body to be brought into contact with recording materials in the fixing unit. The fixing unit T in this exemplary embodiment differs from that in the first exemplary embodiment in that cams 291 and 292 for changing pressure are attached to the rotating shaft of the rotating body (fixing roller 273) that forms a heating nip. In this exemplary embodiment, the fixing unit employs a rigid fixing roller instead of a fixing film.

The fixing roller 273 includes a metallic pipe and an elastic rubber layer composed of silicon rubber, fluororubber, or the like covering the outer periphery of the pipe. This fixing roller 273 and a halogen lamp (not shown) or the like installed inside the roller form a heating unit. As in the fixing roller, a pressurizing roller 238 includes a metallic pipe and an elastic rubber layer composed of silicon rubber, fluororubber, or the like covering the outer periphery of the pipe. Application of pressure to the heating unit including the fixing roller 273 and a heating body such as the halogen lamp installed inside the roller and the pressurizing roller 238 using the below-mentioned pressure-applying mechanism form a pressure-contact nip N serving as a heating nip. Unfixed images formed on the recording materials S are fixed on the recording materials S after the recording materials S pass through this pressure-contact nip N.

Next, pressurizing components for forming the pressure-contact nip N will be described. Both ends of the shaft of the fixing roller 273 are supported by the side plates (not shown) fixed inside the fixing unit T so as to be rotatable. The pressurizing roller 238 is supported by pressurizing plates 265 and 266 at either end of the shaft of the roller so as to be rotatable and pivotable. Moreover, the pressurizing plates 265 and 266 are supported by a supporting shaft 295 fixed to the side plates (not shown) of the fixing unit so as to be pivotable. Application of loads to the pressurizing plates 265 and 266 using pressurizing springs 262 and 263 forms the pressure-contact nip N. In addition to the above-described components, the fixing unit T includes conveying rollers 231 disposed downstream of the heating unit and the pressurizing roller 238 in the conveying direction of the recording materials. Only one of the pressurizing plates 265 and 266 and one of the pressurizing springs 262 and 263 disposed at either end of the heating unit in the longitudinal direction thereof and adjacent to one end of the fixing unit are illustrated. However, the structures of the components adjacent to the other end are the same as those adjacent to the one end.

As described above, the pressure-applying mechanism configured to apply pressure so as to form the pressure-contact nip N includes components for applying pressure such as the pressurizing springs 262 and 263, the pressurizing plates 265 and 266, and a bottom plate 264. However, the structure of the pressure-applying mechanism is not limited to that described above. Structures other than that can be possible as long as the pressure-applying mechanism can apply pressure so as to form the pressure-contact nip N.

Operation of Fixing Unit

Next, operations of the fixing unit during image formation and during releasing or non-releasing of the pressure-contact nip in this exemplary embodiment will be described.

Figure 8:
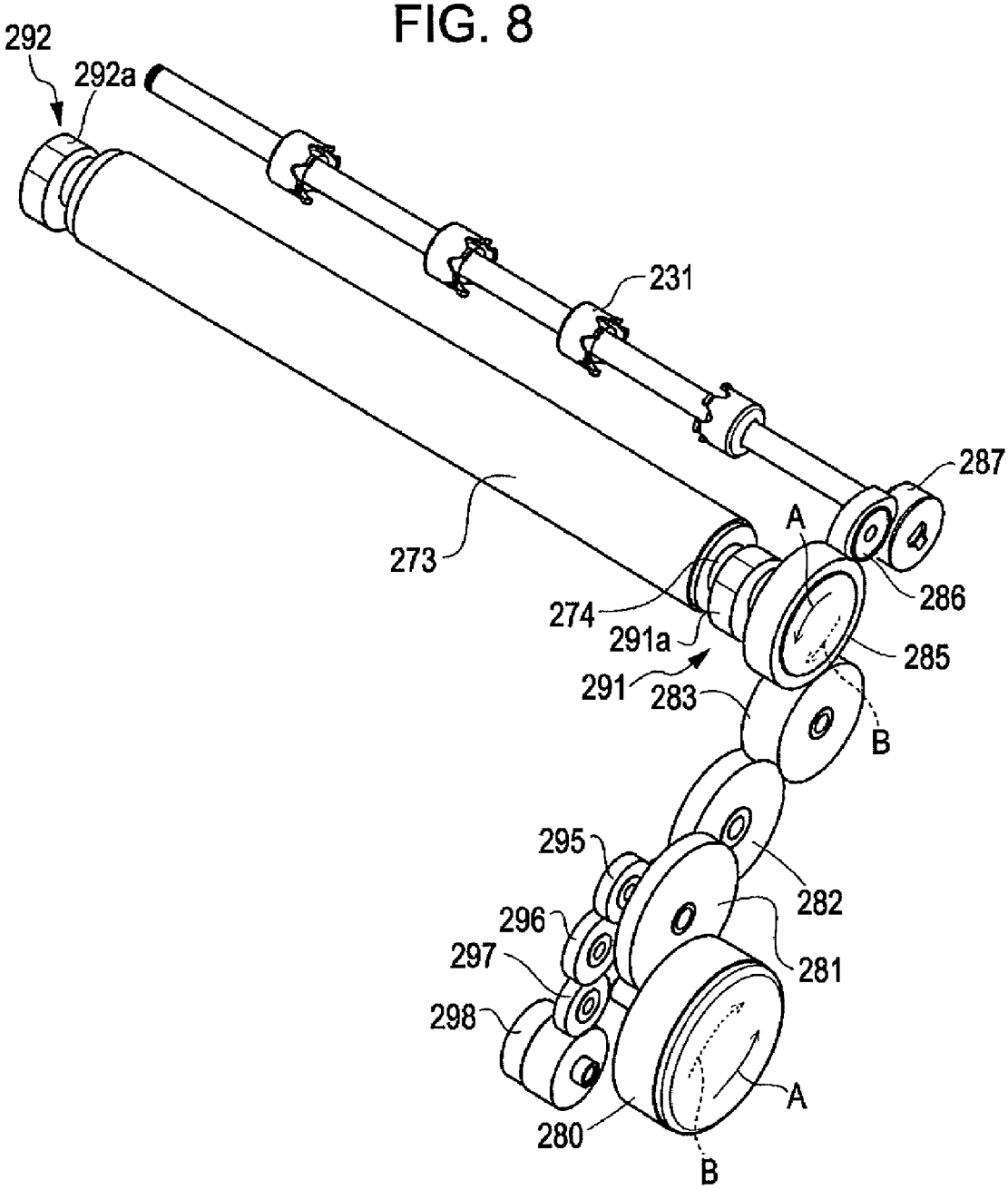
FIG. 8 is a perspective view of a power transmission channel from a motor to a fixing unit according to a second exemplary embodiment of the present invention.
Figure 9:
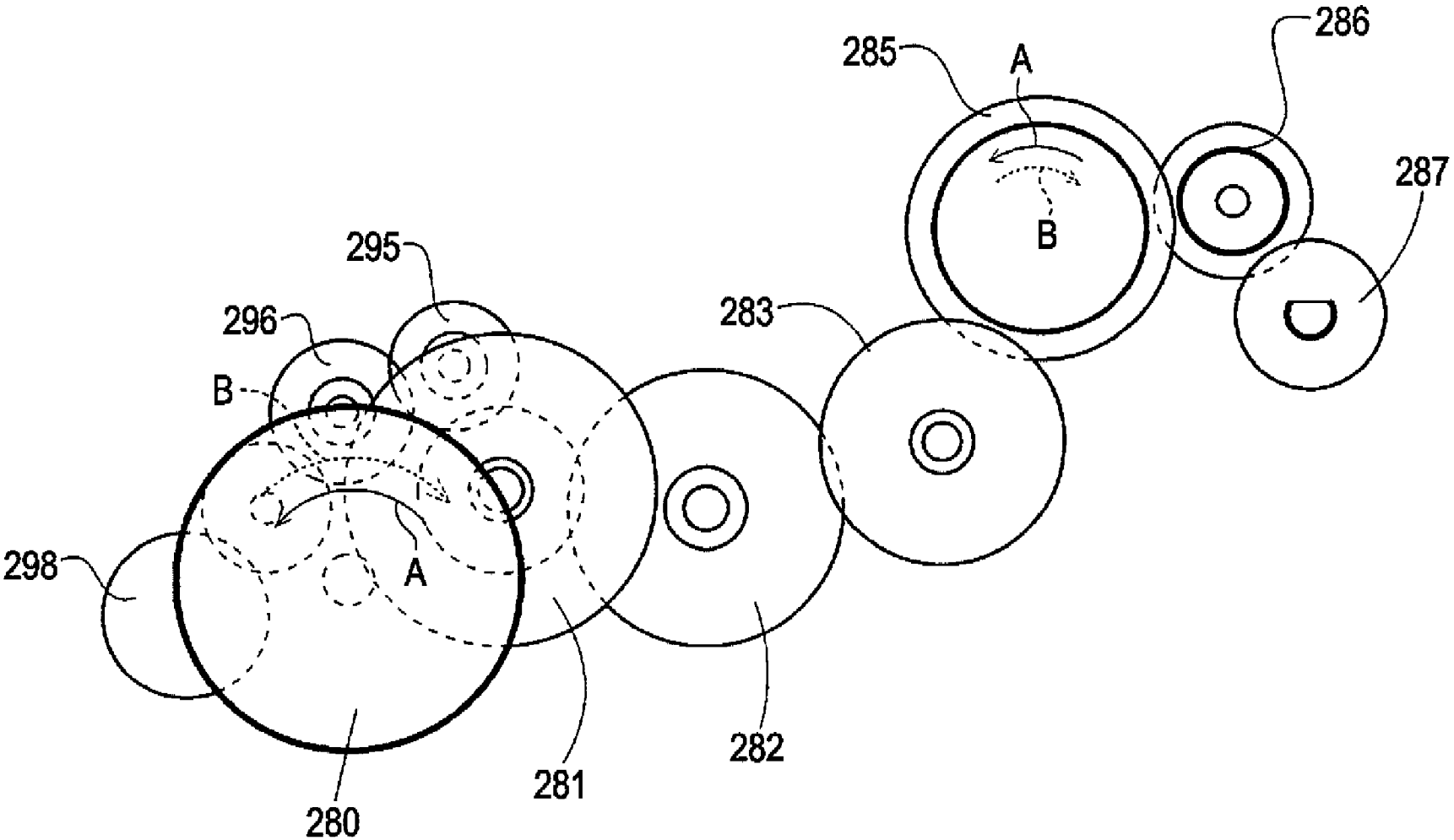
FIG. 9 illustrates gears that constitute the power transmission channel shown in FIG. 8.

With reference to FIGS. 8 and 9, the fixing unit T is driven by a motor 280 serving as a driving source attached to the image forming apparatus E. This motor 280 can be a DC motor, a stepping motor, or the like capable of rotating in a normal direction and in a reverse direction. The power of the motor 280 is transmitted to the fixing unit T by gears 281 to 283 provided for the image forming apparatus E. Unitized gears 285 to 287 are provided for the fixing unit T. Moreover, the driving force of the motor 280 is transmitted to other loads of the image forming apparatus E by gears 295 to 298 via the gear 281. The gear line is the only power transmission channel to the fixing unit T. Since the same gear line is used for transmitting power to the fixing unit T while the motor is rotated both in the normal direction and in the reverse direction, no separate gear lines are required for driving the fixing unit T and for releasing the pressure-contact nip. Thus, the space-saving and low-cost image forming apparatus E and fixing unit T can be realized.

The gear 285 is fixed to the fixing roller 273 so as to transmit the power of the motor 280, and the driving power is transmitted to the fixing roller 273 via the gear 285. The gears 286 and 287 transmit the power to the conveying rollers 231.

The fixing unit T includes a pressure-changing mechanism for changing the pressure applied to the pressure-contact nip N. The pressure-changing mechanism includes cams 291 and 292 serving as cam members acting on the pressure-applying mechanism so as to change the pressure applied to the pressure-contact nip N using the rotation of the cams 291 and 292. The cams 291 and 292 in this exemplary embodiment act on the pressurizing plates 265 and 266, respectively, which are parts of the pressure-applying mechanism. In this exemplary embodiment, the pressure-changing mechanism includes components for changing pressure such as the motor 280 for driving the fixing roller 273 in addition to the cams 291 and 292. However, the structure of the pressure-changing mechanism is not limited to that described above. Structures other than that can be possible as long as the pressure-changing mechanism includes the cams 291 and 292 acting on the pressure-applying mechanism and can change the pressure applied to the pressure-contact nip N using the rotation of the cams 291 and 292.

The cams 291 and 292 acting on the pressure-applying mechanism are attached to a rotating shaft of a rotating body to be brought into contact with the recording materials via one-way clutches (one-way clutch mechanisms). In this exemplary embodiment, the cams 291 and 292 are disposed on a rotating shaft 274 of the fixing roller 273 serving as a rotating body that is to be brought into contact with the recording materials and that forms the heating nip. The power of the motor 280 is not transmitted from the rotating shaft 274 of the fixing roller 273 to the cams 291 and 292 during the rotation of the motor 280 in the normal direction (the direction of the arrow A), and is transmitted from the rotating shaft 274 of the fixing roller 273 to the cams 291 and 292 during the rotation of the motor 280 in the reverse direction (the direction of the arrow B). When the motor 280 is rotated in the normal direction, the fixing roller 273 is rotated in a direction in which the recording materials are discharged during fixing (the conveying direction of the recording materials). When the motor 280 is rotated in the reverse direction, the fixing roller 273 is rotated in a direction opposite to the conveying direction of the recording materials. In this manner, the power transmission to the cams 291 and 292 at either end is performed using the rotating shaft 274 of the fixing roller 273. Since the rotating shaft 274 of the fixing roller 273 is used for the power transmission to the cams 291 and 292 as described above, no other components for transmitting the power to the cams 291 and 292 are required. Thus, the space-saving and low-cost image forming apparatus E and fixing unit T can be realized.

The cams 291 and 292 include cam surfaces 291*a* and 292*a*, respectively, for controlling the positions of the pressurizing plates 265 and 266. Moreover, pressurizing plate 265 includes a light-shielding portion 265*a* for detecting and controlling the state of the pressure-contact nip N. The release and non-release of the pressure-contact nip N is controlled using the light-shielding portion 265*a* of the pressurizing plate 265, a cam sensor 293, and the electrical unit (control unit) 4 of the image forming apparatus E. The cam sensor 293 can be of the transmissive type, and detects the released or non-released state of the pressure-contact nip N using the light-shielding portion 265*a* disposed between a light-emitting portion and a light-detecting portion, the light-shielding portion blocking or passing light. Moreover, the cam sensor 293 is disposed inside the fixing unit T. Since the sensing component for detecting the state of the pressure-contact nip N inside the fixing unit T is disposed inside the fixing unit T instead of the image forming apparatus E, the size of the apparatus is not increased, and the accuracy in detecting the state of the pressure-contact nip N can be improved.

Operation During Image Formation

Figure 10A:
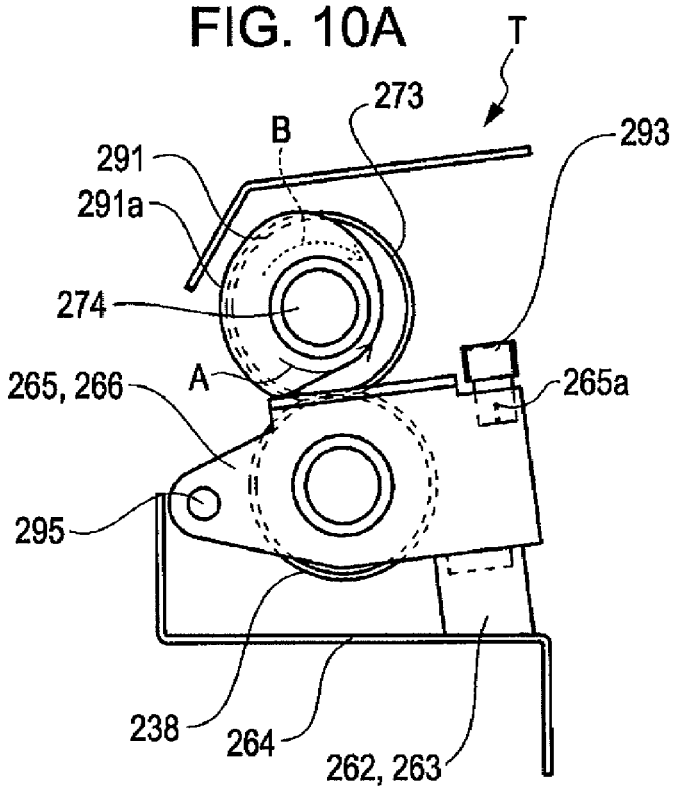
FIG. 10A illustrates the fixing unit viewed from the side during image formation where the pressure-contact nip is formed.
Figure 10B:
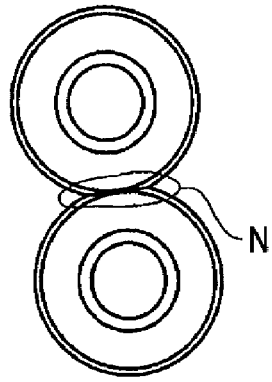
FIG. 10B illustrates the pressure-contact nip N in the non-released state.

As shown in FIGS. 9, 10A, and 10B, the motor 280 is rotated in the direction of the arrow A during image formation, and the power is transmitted to the fixing unit T via the gears 281 to 283. The rotation of the fixing roller 273 and the conveying rollers 231 in the normal direction (direction of the arrow A) fixes the unfixed images on the recording materials and conveys the recording materials. At this moment, the pressure-contact nip N is formed by urging the pressurizing roller 238 toward the fixing roller 273 using the pressurizing plates 265 and 266, the pressurizing springs 262 and 263, and the bottom plate 264. When the gear 285 is rotated in the direction of the arrow A while the cams 291 and 292 are not in contact with the pressurizing plates 265 and 266, respectively, only the idling torque of the one-way clutches is transmitted from the rotating shaft 274 of the fixing roller 273 to the cams 291 and 292. The cams 291 and 292 are stopped when parts of the cams 291 and 292 are brought into contact with the pressurizing plates 265 and 266, respectively. At this moment, the cams 291 and 292 are located at their initial positions. As in the first exemplary embodiment, this idling torque is not so large as to raise the pressurizing plates 265 and 266 against the force of the pressurizing springs 262 and 263. Therefore, the cams 291 and 292 are rotated only until the cams 291 and 292 reach their initial positions when the idling torque is generated by the rotation of the fixing roller 273 in the direction of the arrow A.

Therefore, when the phases of the cams 291 and 292 at the start of the rotation of the motor correspond to the initial positions, the cams 291 and 292 are not rotated even when the motor 280 is rotated in the direction of the arrow A. However, when the phases of the cams 291 and 292 at the start of the rotation of the motor are shifted from the initial positions in the direction of the arrow B, the cams 291 and 292 are rotated until the cams 291 and 292 reach their initial positions.

Since the position initialization is performed using the idling torque of the one-way clutches as described above, no other components for initializing the positions of the cams are required. Thus, the space-saving and low-cost image forming apparatus E and fixing unit T can be realized. The idling torque of the one-way clutches is much smaller than the pressurizing force of the pressurizing springs 262 and 263. While the light-shielding portion 265*a* formed on the pressurizing plate 265 for the detection of the non-released state of the pressure-contact nip N blocks light from reaching the cam sensor 293, the non-released state of the pressure-contact nip is detected.

Operation During Releasing of Pressure-Contact Nip N

Figure 11A:
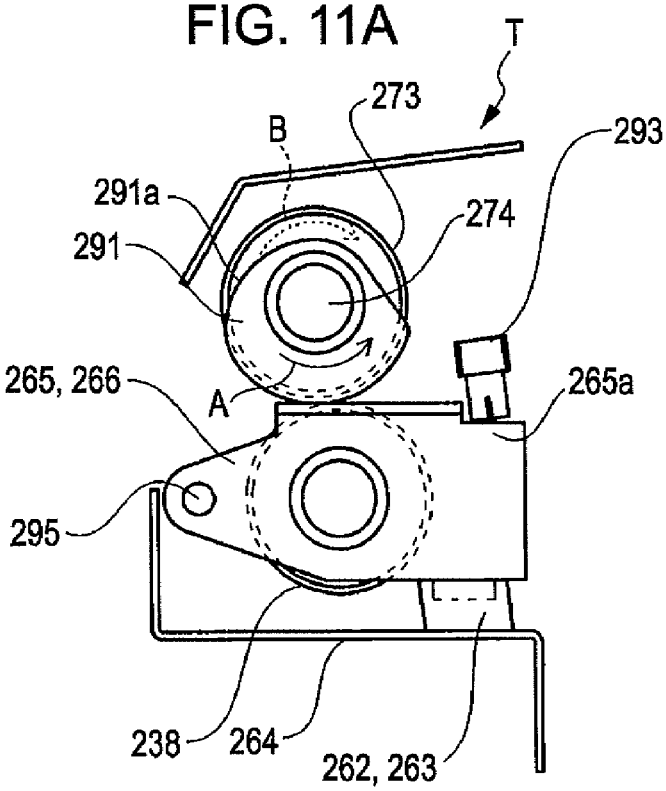
FIG. 11A illustrates the fixing unit where the pressure-contact nip is released.
Figure 11B:
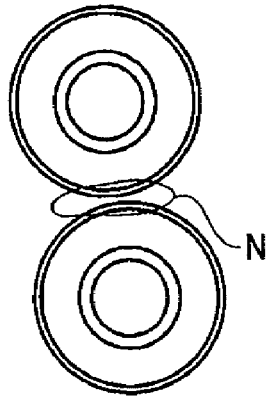
FIG. 11B illustrates the pressure-contact nip N in the released state.

When it is necessary to release the pressure-contact nip N, the motor 280 is rotated in the reverse direction (direction of the arrow B). As shown in FIGS. 9, 11A, and 11B, the power from the rotation of the motor 280 in the reverse direction is transmitted to the fixing unit T by the gears 281 to 283. Since the power of the motor rotated in the reverse direction is transmitted using the same gear line as that used for transmitting the power from the motor rotated in the normal direction, the space-saving and low-cost image forming apparatus E and fixing unit T can be realized. The power in the reverse direction (direction of the arrow B) transmitted from the gear 285 to the rotating shaft 274 of the fixing roller 273 is transmitted to the cams 291 and 292 via the one-way clutches so as to rotate the cams 291 and 292 in the direction of the arrow B. The cam surfaces 291*a* and 292*a* of the cams 291 and 292 act on surfaces of the pressurizing plates 265 and 266, respectively, the surfaces being formed by bending. As a result, the pressurizing plates 265 and 266 are moved against the force of the pressurizing springs 262 and 263, respectively, so as to release the pressure-contact nip N. When the light-shielding portion 265*a* formed on the pressurizing plate 265 is retracted at the same time as when the pressure-contact nip N is released, the cam sensor 293 receives light and detects the displacement of the pressurizing plates 265 and 266. With this, the electrical unit 4 stops the rotation of the motor 280. Releasing the pressure-contact nip N allows regulating the permanent deformation of the elastic layer of the fixing roller and the pressurizing roller, and allows for easy removal of the recording materials jammed in the fixing unit. Therefore, in this exemplary embodiment, the pressure-contact nip is automatically released when the image forming apparatus is switched off and when the recording materials are jammed.

Operation During Return of Pressure-Contact Nip N from Released State to Non-Released State When it is necessary to return the pressure-contact nip N from the released state to the non-released state, the motor 280 is further rotated in the reverse direction (direction of the arrow B). The power from the motor 280 is transmitted to the cams 291 and 292. The cams 291 and 292 are rotated in the reverse direction (direction of the arrow B) so as to bring the pressure-contact nip N to the non-released state (pressure-contact state). When the cam sensor 293 detects that the pressure-contact nip N is returned to the non-released state, the electrical unit 4 stops the rotation of the motor 280. When the motor 280 is rotated in the normal direction (direction of the arrow A) after the pressure-contact nip N is returned to the non-released state, the cams 291 and 292 are brought into contact with the pressurizing plates 265 and 266, respectively, by the idling torque of the one-way clutches inside the cams 291 and 292, and then are stopped. At this moment, the cams 291 and 292 are located at their initial positions.

The pressure applied to the pressure-contact nip N is not necessarily removed completely, but can be reduced during releasing of the pressure-contact nip N. This can be easily realized by appropriately setting the shapes of the cam surfaces 291*a* and 292*a* of the cams 291 and 292, respectively, for controlling the positions of the pressurizing plates. The cam surfaces 291*a* and 292*a* designed to have various patterns for various pressure applications can realize fixing units capable of varying the pressure applied to the pressure-contact nip N.

In this exemplary embodiment, the cams are disposed on the rotating shaft of the fixing roller. However, the cams can be disposed on the rotating shaft of the pressurizing roller.

As described above, the cams 291 and 292 acting on the pressure-applying mechanism are disposed on the rotating shaft 274 of the fixing roller 273 of the fixing unit T in this exemplary embodiment. With this structure, the pressure applied to the pressure-contact nip N can be changed without an increase in the cost or size of the fixing unit T and the image forming apparatus E.

Since the cams 291 and 292 are rotated by the power of the motor 280 that drives the fixing roller 273, no other driving source is required. Thus, the space-saving and low-cost image forming apparatus E and fixing unit T can be realized.

Other Exemplary Embodiments

In the above-described exemplary embodiments, heat fixing devices installed in image forming apparatuses such as printers and copiers are illustrated as examples of image heating devices. However, the present invention is not limited to such heat fixing devices, and can be applied to, for example, gloss-adding devices that improve the glossiness in images formed on recording materials. Moreover, the present invention can be applied to image heating devices that are not installed in image forming apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the priority of Japanese Application No. 2006-084515 filed Mar. 27, 2006, which is hereby incorporated by reference herein in its entirety.

What is claimed is:

1. An image heating device for heating an image formed on a recording material, comprising:

a nip-forming member;

a pressure-applying mechanism configured to apply pressure to the nip-forming member so as to form a heating nip where the recording material is heated;

a pressure-changing mechanism including a rotatable cam member acting on the pressure-applying mechanism so as to change the pressure applied to the nip-forming member by the pressure-applying mechanism; and a one-way clutch mechanism, wherein the cam member is attached to a rotating shaft of a rotating body that can be brought into contact with the recording material via the one-way clutch mechanism, and wherein the cam member is not rotated when the rotating body is rotated in a direction in which the recording material is conveyed, and the cam member is rotated when the rotating body is rotated in a direction opposite to the conveying direction of the recording material.

2. The image heating device according to claim 1, wherein the rotating body is disposed at a position remote from the heating nip in the conveying direction of the recording material.

3. The image heating device according to claim 2, wherein the rotating body is disposed downstream of the heating nip in the conveying direction of the recording material.

4. The image heating device according to claim 3, wherein the rotating body includes a conveying roller disposed immediately downstream of the heating nip in the conveying direction of the recording material.

5. The image heating device according to claim 2, further comprising a driving source configured to rotate the rotating body and the cam member and to drive the nip-forming member.

6. The image heating device according to claim 5, wherein the nip-forming member includes a flexible sleeve and a pressurizing roller that is brought into contact with an outer periphery of the flexible sleeve.

7. The image heating device according to claim 1, wherein the rotating body forms the heating nip.

8. The image heating device according to claim 7, further comprising a driving source configured to rotate the cam member and drive the rotating body.

9. An image forming apparatus for forming images on recording materials, comprising:

an image forming unit forming unfixed images on the recording materials; and a fixing unit configured to fix the unfixed images on the recording materials, the fixing unit including the image heating unit according to claim 1.

* * * * *